US005634572A

United States Patent [19]

Lane, Jr. et al.

[11] Patent Number: 5,634,572

[45] Date of Patent: *Jun. 3, 1997

[54] DISPENSER SYSTEM WITH COLLAPSIBLE POUCH

[75] Inventors: William A. Lane, Jr., Lake Arrowhead; Steven D. Davis, Yuciappa, both of Calif.; Chester F. Robards, Jr., Roselle, Ill.

[73] Assignee: Winpak Lane, Inc., San Bernardino, Calif.

[ * ] Notice: The term of this patent shall not extend beyond the expiration date of Pat. No. 5,632,416.

[21] Appl. No.: 378,806

[22] Filed: Jan. 27, 1995

Related U.S. Application Data

[63] Continuation-in-part of Ser. No. 10,766, Jan. 29, 1993.

[51] Int. Cl.[6] ..... B65D 35/28

[52] U.S. Cl. ..... 222/95; 222/105; 222/326

[58] Field of Search ..... 222/95, 105, 326, 222/107, 96, 386, 386.5, 391, 541.6; 426/115; 206/804

[56] References Cited

U.S. PATENT DOCUMENTS

| | | | |
|---|---|---|---|
| 2,956,710 | 10/1960 | O'Connor | 222/541.6 |
| 3,913,789 | 10/1975 | Miller | 206/484 |
| 3,933,273 | 1/1976 | Cox | 222/95 |
| 4,007,838 | 2/1977 | Awad | 206/484 |
| 4,227,614 | 10/1980 | Hollander, Jr. | 426/115 |
| 4,711,373 | 12/1987 | Christine | 222/95 |
| 4,797,309 | 1/1989 | Kammerer et al. | 222/541.6 |
| 4,872,556 | 10/1989 | Farmer | 222/107 |
| 4,932,562 | 6/1990 | Christine | 222/96 |
| 5,323,931 | 6/1994 | Robards, Jr. et al. | 222/96 |

*Primary Examiner*—Philippe Derakshani
*Attorney, Agent, or Firm*—James G. O'Neill

[57] ABSTRACT

A dispenser system having a substantially large pouch (20) for holding a substantially large amount of viscous food product for dispensing from a dispenser (122). The pouch is formed so as to include a tear strip (38) to open a funnel-shaped, centrally disposed outlet spout (24) and to be sealingly held in the dispenser. The pouch may include a pair of alignment/holding openings (32, 34) formed on either side of the outlet spout for aligning the pouch in a preferred position in the dispenser, so that a piston-type extruding member (136) may pressurize and dispense predetermined size shots of viscous food product therefrom.

13 Claims, 5 Drawing Sheets

DISPENSER SYSTEM WITH COLLAPSIBLE POUCH

CROSS REFERENCE TO RELATED APPLICATION

This is a continuation-in-part of copending application Ser. No. 08/010,766, filed on Jan. 29, 1993.

TECHNICAL FIELD

This invention relates generally to dispenser systems with pouches for holding liquified or pulverized products, and more particularly, to an improved dispenser system with a collapsible, sanitary pouch for dispensing food products.

BACKGROUND ART

Various types of dispensers, including hand-held dispensers, utilizing collapsible pouches are well known. One such dispenser is set forth in U.S. Pat. NO. 5,323,931 ('931) issued Jun. 28, 1994, from an application filed on Feb. 8, 1993. This '931 patent sets forth the details of a specific hand-held dispenser adapted for use with a collapsible dispenser pouch of the type set forth in this application.

Because of the technical advances in film pouch forming, filling and sealing machines, more and more food and related products, in various states, are being packaged in flexible film pouches for dispensing of such products. Known machines to form, fill and seal such pouches utilize continuous rolls of film. Pouches are formed from the rolls of film, filled with product and then sealed in a continuous process.

To form pouches on these known form, fill and seal packaging machines, side seals are normally formed between front and back films by side seal forming means and a cross seal forming means is then utilized to form the bottom seal. This three-sided pouch is then filled with product and the machine indexed to forward the filled pouch. The same cross seal forming means is then utilized to form the top seam on this filled pouch. At the same time, it forms the bottom seam on the next partially formed, but still empty pouch. The formed pouch is then severed from the moving streams of front and back heat sealable films and is discharged from the machine. The machine is indexed and the cycle then continued.

The side seams or side seals of the pouch are formed at one station by side seal forming means, while the cross seams or cross seals are formed by a head seal containing opposing front and back seal bars which come together to join front and back rolls of material by pressure and heat. The combination of heat and pressure at both stations form cross and side seals between the films to create the various pouch seams. Examples of such machines are disclosed in U.S. Pat. No. 4,768,330 ("'330"), assigned to W. A. Lane, Inc. of San Bernardino, Calif., the assignee of the present invention. The disclosure of this patent is incorporated herein, in its entirety, by this reference thereto. Further such machines are disclosed in U.S. Pat. No. 4,845,926, also assigned to W. A. Lane, Inc.

As discussed in the '330 patent, the typical form, fill and seal packaging machine is capable of concurrently forming a linear array of side by side pouches across the width of the machine. The number of side by side pouches concurrently formed can vary from a single pouch, when large, wide pouches are being formed, up to a large number of narrow pouches, depending on the limits of the machine size and material(s) being used. The cross sealing means and separate cut-off or severing means to form such pouches must extend across the width of the material being formed, filled and sealed in the machine.

The final size of a pouch formed on a pouch packaging machine is usually determined by the amount and type of contents to be held in the pouch and how the contents will be dispensed from the pouch. Thus, the geometry of a pouch is highly dependent upon what the pouch will ultimately contain, as well as how and where its contents is to be dispensed.

Some specifically designed smaller pouches or containers are known for use in hand held and other devices for dispensing viscous food products. These known pouches and dispensing means have numerous drawbacks or problems, including, but not limited to, cost of labor to produce and/or use, packaging expense, portion control, sanitation, speed of dispensing and waste generation. Furthermore, such known pouches or containers usually have integral fitments or valving mechanisms that must be somehow operated or opened by the dispensing means to dispense the items contained therein.

With the current global concerns over environmental and safety issues, such as, sanitation in the delivery, storage and handling of food products, the need to cut down on solid waste and the need to save energy, large sanitary pouches offer a simple and elegant solution to many of these concerns. Therefore, there exists a need in the packaging and dispensing art for a relatively large, collapsible, sanitary dispensing pouch for use in holding and dispensing viscous food products from dispensing systems, which pouch overcomes the above set forth drawbacks and which can be easily manufactured and filled in existing machinery by use of specific tooling in accordance with the present invention.

DISCLOSURE OF THE INVENTION

Accordingly, it is a general object of the present invention to provide an improved dispenser system having a collapsible, sanitary dispensing pouch. It is a more particular object of the present invention to provide a collapsible dispensing pouch for use in a dispenser system. It is a further object of the present invention to provide a novel combination dispenser and collapsible dispensing pouch system in which the pouch is formed by a novel head seal means. It is yet another object of the present invention to provide a novel collapsible dispensing pouch without an integral fitment, and which contains a relatively large amount of viscous food product for accurate, controlled dispensing from a dispenser. And, it is yet a more particular object of the present invention to provide a dispenser system having a collapsible dispensing pouch having a body which is adapted to assume the substantially elliptical in cross section shape of a hand held dispenser housing for holding such pouch, and to allow accurate, and complete, controlled dispensing of product from such pouch, by operation of the hand held dispenser.

In accordance with the present invention there is provided a novel dispenser system having a novel collapsible pouch with a tear-off portion adjacent a specifically formed outlet spout adapted to be sealingly held in a dispenser. The pouch includes a novel head seal adapted for use in known form, fill and sealing machines for forming a plurality of such pouches. The dispenser includes a housing which is substantially elliptical in cross section and the pouch containing viscous food product is inserted and held in the dispenser and is adapted to assume an elliptical shape to allow accurate, and complete, controlled dispensing of such viscous food product, with minimum back-pressure from a spout in the pouch, by the dispenser.

BRIEF DESCRIPTION OF DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

BEST MODES FOR CARRYING OUT THE INVENTION

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for a novel collapsible, sanitary dispenser pouch of relatively large size designed to be used with a dispenser and particularly a hand held dispenser; head seal tooling to simultaneously form top and bottom cross seals for a plurality of such pouches, as well as a perforated tear-off portion and an optional pair of alignment openings in selected pouches, and to cut-off formed and filled pouches from moving streams of front and back heat sealable films from which the pouches are formed.

Figure 1:
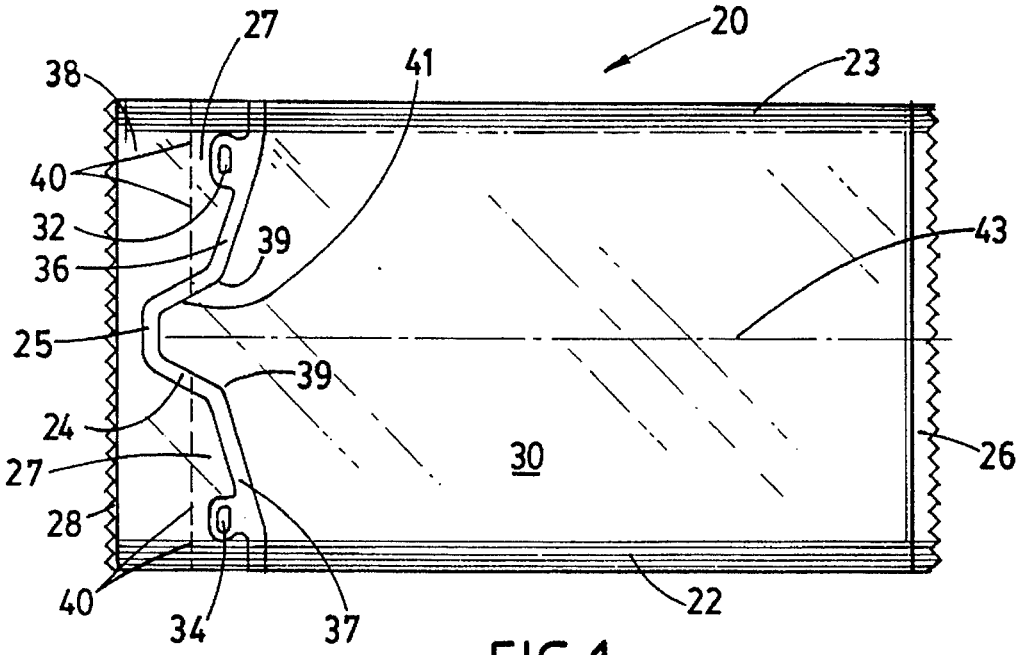
FIG. 1 is a front elevational view of a formed, partially air filled and sealed, collapsible dispensing pouch in accordance with the present invention.
Figure 2:
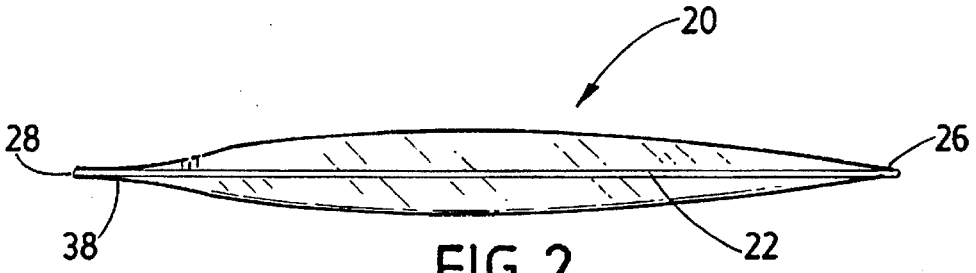
FIG. 2. is a side elevational view of the pouch of FIG. 1.
Figure 3:
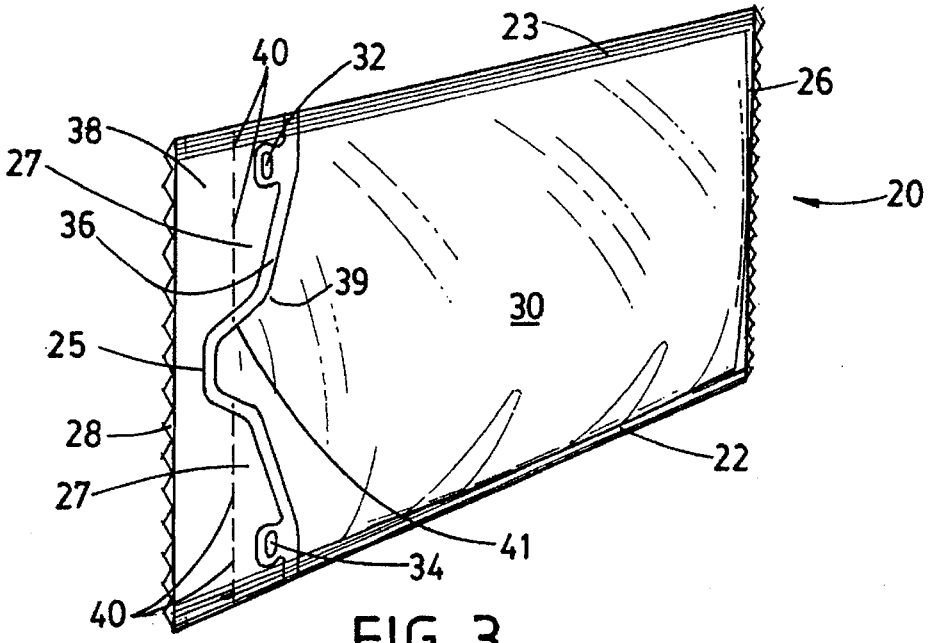
FIG. 3. is a perspective view of the pouch of FIG. 1.

Turning first to FIGS. 1–3, there shown is a novel collapsible, sanitary dispenser pouch 20 formed in accordance with the present invention, partially air filled, and without any food product therein. The pouch 20 has a pair of side seals 22, 23 formed thereon, in a known manner, as in available form, fill and seal machines from W. A. Lane, Inc., the assignee of the present invention. The pouch 20 includes a centrally disposed outlet nozzle or spout 24, having a tear-off opening or tip 25, described more fully below, formed in a cross seal at the outlet, top or upper end 28 thereof, between the side seals 22, 23. Additionally, the pouch 20 includes a bottom or lower cross or end seal 26 and at least one top or upper cross seal. As shown in FIGS. 1 and 2, a first or single top cross seal means may be formed by the sealed tip 25 of spout 24 and further angularly descending seal means or wall portions 36 and 37, described below. If desired, a further top, upper or outlet end cross seal may be provided at the furthest point on the outlet end 28, immediately above the cross seal means containing the outlet nozzle 24.

Figure 13:
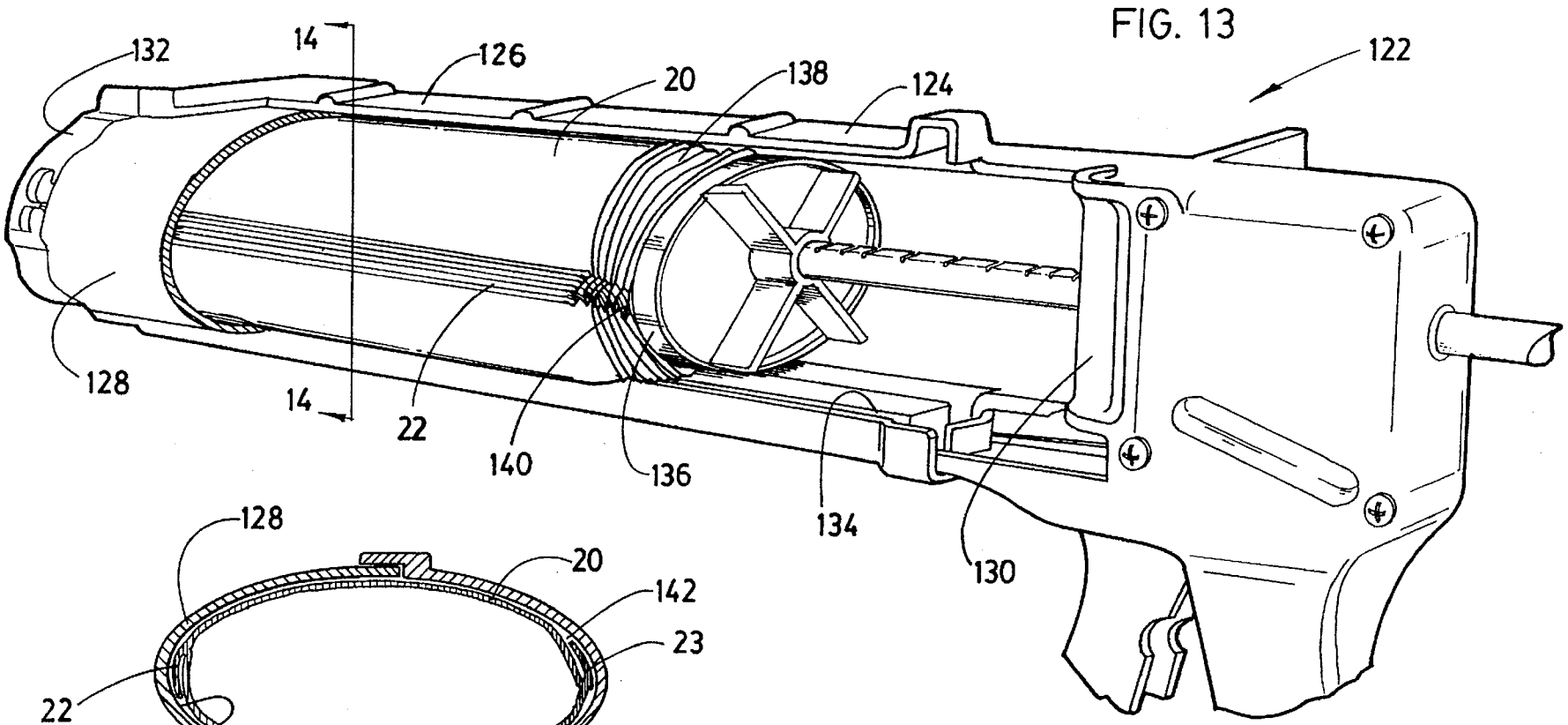
FIG. 13. is a partial, perspective view of a housing of a preferred type of hand held dispenser, in which a portion of the housing is cut away to show that the dispenser has a substantially elliptical cross section, with a pouch of the present invention therein, to illustrate how the pouch also assumes a substantially elliptical cross-section when the hand held dispenser is operated to pressurize the pouch so as to dispense accurate portions of viscous food product from the open nozzle of the pouch.

An inner chamber 30, is formed in the pouch 20, between the side seals 22 and 23, bottom cross seal 26, and the first cross seal means formed by the centrally disposed outlet nozzle 24 and the angular seal means 36 and 37. A relatively large amount of viscous food product, such as the 24 to 30 fluid ounces (71 to 89 cl) discussed below, may be placed in and sealingly held in this chamber 30, for dispensing through the opening formed in the centrally disposed outlet spout 24, when the pouch is held in a dispenser, such as shown in FIG. 13, and the end or tip 25 opened or removed, as described below. If desired, a pair of alignment/holding openings 32, 34, may be formed extending entirely through both sheets of heat sealed film forming the pouch 20, adjacent the angular seal means 36 and 37, in a substantially flat area 27, on either side of the sealed outlet spout 24, outside or away from the interior chamber 30, adjacent the side seals 22, 23, and below a tear-off strip 38, described below. These alignment/holding openings 32, 34 are accurately formed in predetermined positions, to aid in the insertion of the pouch in the proper position in a dispenser, such as a hand held dispenser, and to properly align the filled pouch in the dispenser, as disclosed more fully below.

The angular seal means or wall portions 36 and 37 are preferably formed as portions of the first cross seal means, and as shown in FIG. 1 extend from the side seals 22 and 23 to the outlet spout 24, at a specific angle, such as approximately 15 degrees from parallel to the outlet end 28 and bottom seal 26, both of which are substantially straight and perpendicular to the side edge seals 22, 23. The preferred angle of this first cross seal means may also be characterized as being approximately 75 degrees to the side seals 22, 23. It, therefore, can be seen that the seal means 36 and 37 form angled or sloping end walls or sealed portions that converge toward the outlet spout, as they extend between the side seals 22, 23 and the outlet spout 24. The openings 32 and 34 allow a filled pouch 20 to be properly positioned in a dispenser, such as the hand held dispenser shown in FIG. 13, so as to be properly aligned therein and to be placed over a hook, pin, or other means, passing through one or both of the openings 32, 34. With the pouch properly aligned in a dispenser, the contents of the pouch may be accurately and fully dispensed from the dispenser through the nozzle 24, when the nozzle 24 is opened, as described below. That is, the operation of the dispenser pressurizes the pouch so that the contents of the pouch are directed to the outlet spout 24 by the angular sealed or wall portions 36 and 37, around curved or rounded edges 39 and down or through a funnel shaped or sloped internal surface or opening 41 within the spout 24. This pressurization by the dispenser causes the pouch to empty in an accordion-type fashion or manner, as described more fully below. The internal surface 41 of the pouch preferably slopes at an angle of approximately 30 degrees from the centerline 43 of the pouch, as shown in FIG. 1.

Figure 14:
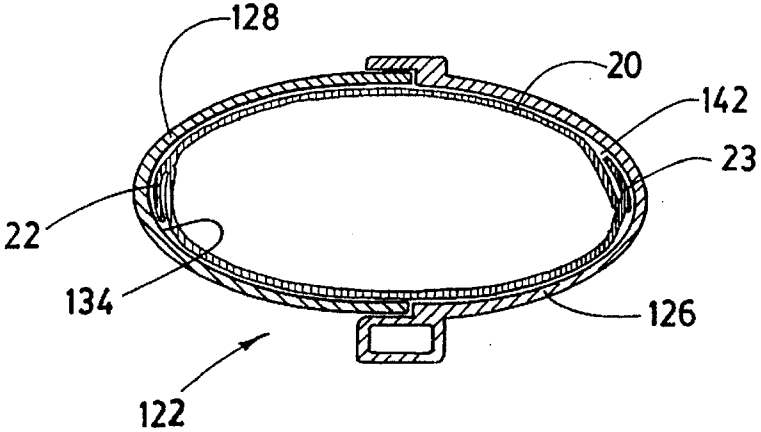
FIG. 14 is a cross sectional view taken along line 14—14 of FIG. 13.

The design of the collapsible pouch 20 provides optimization of positive displacement, portion control and full evacuation when used in substantially any dispenser, such as a hand held dispenser, as generally indicated at 122 in FIGS. 13 and 14. This hand held dispenser 122 has a housing 124, with an elongated lower or right portion 126, an elongated upper or left portion 128, a rear plate 130 closing the lower portion, and a front plate 132 closing the entire front of the housing. The upper or left portion 128 of housing 124 forms a removable cover for the housing and combines with the lower portion 126 to define an interior cavity 134, which effectively defines a substantially elliptical or oval shaped, pouch holding area or means therein. Therefore, with the removable cover opened, the pouch 20 of the present invention may be inserted and held in the interior cavity 134. The substantially elliptical cross section of the interior cavity 134 is sized and dimensioned to capture the pouch 20 in the interior cavity in such a manner that when the dispenser 122 is operated the pouch will be pressurized and assume the shape of the interior cavity and to enable accurately controlled evacuation of the pouch, in predetermined amounts ("shots") of viscous fluid through the nozzle 24 of the pouch, one shot at a time. As shown in FIGS. 13 and 14, with the pouch 20 in the interior cavity 134 and the cover 126 closed, the pouch will be caused to assume the shape thereof so as to be snugly captured therein, upon pressurization of the pouch. Although no space will occur during operation, FIG. 14 shows an exaggerated space 142 between the pouch and the inner wall of interior cavity, to more clearly illustrate how the pressurized pouch 20 fits in the interior cavity.

The evacuation of the pouch 20 in the dispenser 122 is accomplished by use of an operating means, such as a substantially elliptically shaped piston-type plunger, or extruding member 136, which is pressed against the rear of the pouch 20 to first cause it to take the shape of the interior cavity 134 and then accurately dispense the contents of the collapsible pouch, as the pouch is pressurized further in the interior cavity 134 by the operation of the operating means. When pressurized, the pouch has been designed so that as the contents thereof are dispensed the pouch will be caused to collapse in an accordion type fashion or manner. That is, the actuation of the piston-type extruding member 136 in the interior cavity 134 pressurizes the flexible pouch 20 to produce accordion-type folds 138, as the pouch is collapsed. In addition, the side seals 22, 23 of the pouch create further collapsing bulges 140 at opposite sides of the pouch (not shown), in order to ensure that the pouch is substantially evacuated, thereby eliminating costly waste.

Extensive studies have shown that the specifically shaped pouch 20 of the present invention, operates best with, and is the preferred way to allow full evacuation and accurate portion control of any viscous food product in the pouch by operation of a dispenser, such as hand held dispenser 122. This occurs because when using a dispenser, such as hand held dispenser 122, even though the rectangular shaped pouch, using edge joining of separate rectangular sheets, as disclosed herein, is not the ideal shape for dispensing fluids or viscous food product using a collapsible pouch and a piston plunger, the combination of the shape and position of the outlet spout 24 in the pouch produce what are considered to be the best available results.

Although it would appear at first blush that the best type of pouch to use would be a cylindrical dispenser pouch, this was tried and presented problems in the ends and the nozzle of such a pouch. This is because although the cylindrical shape is ideal for a dispenser for "infinitely long" pouches, in the real world a fixed pouch length requires that the pouches be sealed transverse to their length. Nominally, and most expeditiously, this would be a simple 90 degree cross seal.

However, when a pouch such as that disclosed herein, with a length approximately twice its width, is filled and transverse sealed at its ends and loaded (pressurized) in the open, such a pouch becomes nearly cylindrical at the midpoint along its length, but is flat at the transverse sealed ends and the end corners became semi-conical and presented themselves more axially than transversely. The transition area between the flat and cylindrical approximates an ellipse. When forced into a flat bottomed, fully cylindrical dispenser, the ends of such a pouch have severe wrinkling problems.

An elliptical shape is a very good approximation of a cylindrical shape, and therefore, the interior cavity 134 of dispenser 122 uses an elliptical cross section interior cavity to hold the pouch 20 of the present invention. The curvature of the interior cavity 134 holds the generally oval pouch 20 in place and forces the pouch to assume the elliptical cross-section of the interior cavity, when the pouch is pressurized therein. This shape of the interior cavity strengthens the walls of the dispenser by changing some of the load from bending to tensile (less deflection), and allows the film from which the pouch is made to be partially loaded to reduce the total force on the dispenser wall. It is also the natural shape of the pouch as it transitions from cylindrical to the flat edge of the transverse end seals. Specifically, a pouch 20 having an internal chamber 30 which is elliptical in cross section, when placed in and pressurized in the interior cavity, reduces the height to width aspect ratio (1:1 in a cylinder) to more closely approximate the shape of the nozzle area 24, 41 of the pouch of the present invention. Also important is that most of the reduction is from the "height", which decreases the distance the film needs to transition from the pouch main body cross section to the nozzle cross section (height to height ratio -"height" being defined as perpendicular to a line from side seal 22 to side seal 23 in FIG. 14). This allows a smoother, more predictable transition, with fewer wrinkles in the pouch, in more predictable locations.

The elliptical shaped cross section of the interior cavity 134 which is assumed by the pouch 20 of the present invention, when in a dispenser and pressurized, allows for a pouch constructed of flexible film to perform as if it were a relatively rigid dispenser pouch, thereby allowing a simple, material efficient, shaped and sized (weight, size and cost being critical), flexible plastic container to be used to hold and accurately dispense large quantities of fluid material.

Additionally, it was found by experimentation that a pouch which assumed the elliptical cross section of the interior cavity when pressurized, and which had a 90 degree seal at the nozzle end 24 of the pouch would wrinkle or become concave at this end, when viewed from the wide side. This wrinkling caused folding at the nozzle 24 causing flow restrictions and/or retraction of the nozzle past a shut-off valve in an opening in front plate 132 of the dispenser 122. The tendency of the pouch end to become concave under pressure caused the nozzle to move rearwardly, relative to the dispenser shutoff valve during a dispensing cycle, which decreased the valve effectiveness, and/or caused the nozzle opening to pull completely away from the valve face.

Further experimentation showed that a non-90 degree seal at the nozzle end 24 of the pouch affected the amount of the concavity and the wrinkling, but most angles were not viable—especially those normally used or seen on other pouches. It was found that if the cross seal was set at 75 degrees with respect to the side seals 22, 23 (FIG. 1, 36, 37), the loaded pouch presented a nozzle end 24 with no concavity, minimized the formation of conical corner points, and also minimized wrinkling at the nozzle end 24 of the pouch 20.

Furthermore, by tapering the nozzle (FIG. 1, elements 24, 41), as described herein, wrinkling was reduced at its juncture to the main transverse pouch seal, and stability was provided during dispensing. Also, the radii or radiused wall portions (FIG. 1, elements 39), at the junction of the pouch nozzle area to the body area, serve two significant functions. One is to reduce stress at the corner, and the other is to improve wrinkle control by softening the transition from one ellipse diameter to the nozzle ellipse diameter.

Any dispenser for use with the collapsible pouch of the present invention should preferably include a valve or closure means positioned so as to cooperate therewith, and open and close the outlet nozzle 24 of the pouch. Therefore, after the pouch is placed in a dispenser, such as hand held dispenser 122, and initially pressurized, the tear strip 38 is removed to remove the tip 25. The hand held dispenser 122 includes such a valve (not shown) in the front plate 132, which valve is also opened when the piston-type operating means or plunger 136 is operated, to accurately dispense the entire contents from the pouch, in desired portions or shots. As stated above, the angular or descending walls or sealed portions 36 and 37 of the chamber 30, together with the contour, position and shape of the interior chamber 30 of the pouch 20, and the internal shape 41 and size of the opening of spout 24 ensures proper flow, by eliminating any areas or corners where product could be held, or product flow could be interrupted or disturbed. Furthermore, with the pouch held and pressurized in the elliptical shaped interior cavity 134, the pouch will assume the desired elliptical shape of the interior cavity until the piston-type operating means reaches the end of its stroke or travel. In this manner, substantially all of the viscous product in the collapsible pouch may be evenly dispensed, in accurate, predetermined increments, from the internal chamber 30 through the centrally disposed outlet spout 24, by the operating means 136 of the dispenser 122.

The pouch 20 must be made from material which will remain sanitary and is sufficiently flexible to enable the pouch to be pressurized so as to collapse in an accordion-like manner when the operating means of the dispenser 122 acts against the pouch, so as to substantially, completely empty the contents therefrom, as described above. Such materials are now readily available and used in the food industry. Furthermore, although the pouch may be formed in various sizes and shapes, it is preferably formed so as to be substantially rectangular in shape in the x-y dimensions, as shown in FIGS. 1–3, and substantially oval in cross section (when filled) with narrowed or pointed ends in the z dimension, as shown in FIG. 3. The following are the preferred dimensions of one embodiment of the invention:

length (x)-approximately twelve (12) inches or 305 mm;

width (y)-approximately six (6)inches or 152.5 mm;

thickness, when full (z) —because oval shape varies, up to approximately one (1) inch or 25.4 mm in the center thereof when filled and laid flat, but expands to assume the elliptical shape of the interior cavity 134, when the pouch is being pressurized, by operating means, such as that shown in dispenser 122 of FIG. 13.

Figure 4:
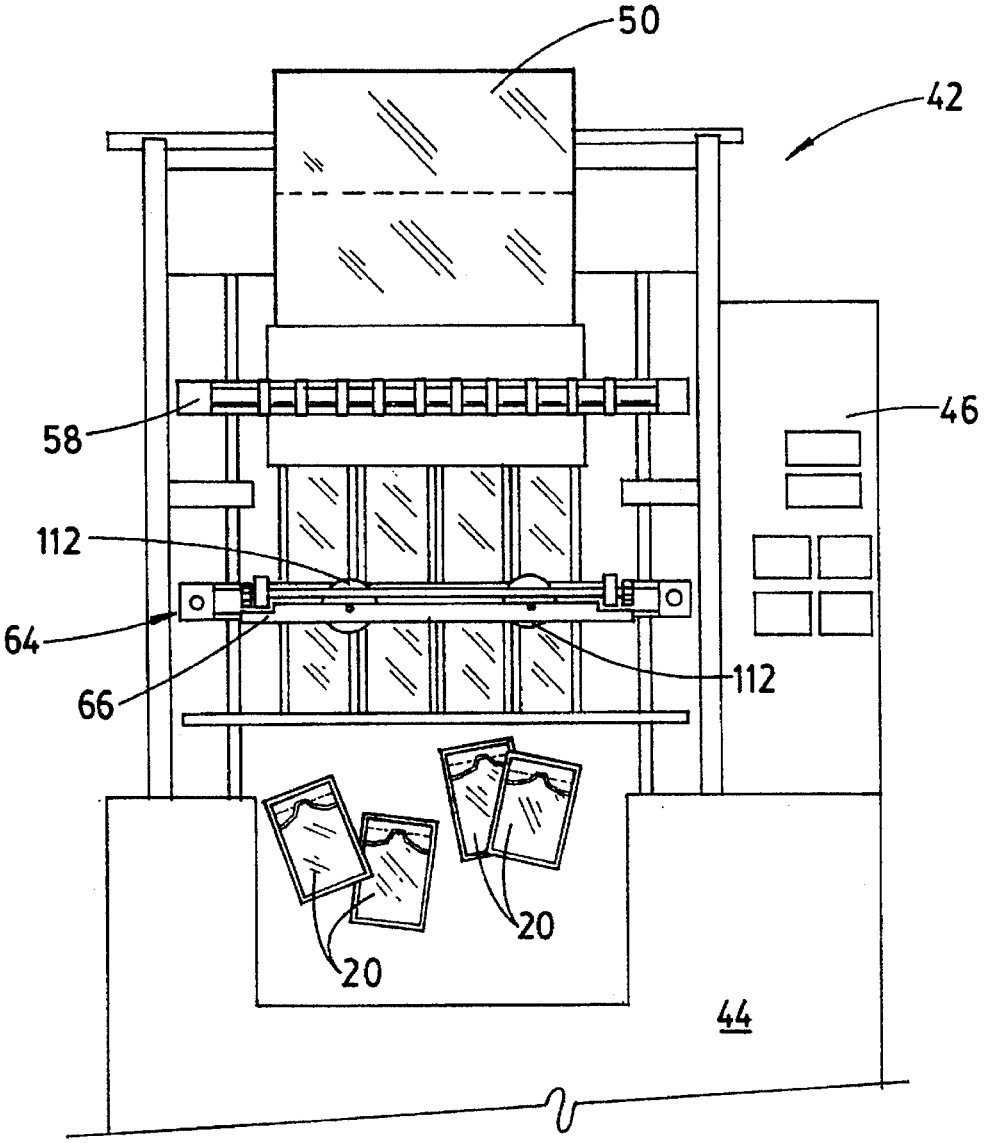
FIG. 4. is a schematic front elevational view of a representational form, fill and seal packaging machine.
Figure 5:
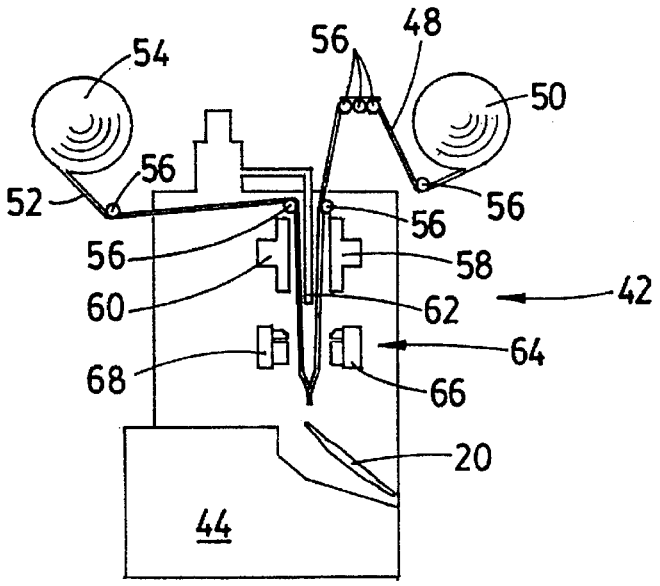
FIG. 5. is a side elevational view of the machine of FIG. 4.

A plurality of pouches 20 are preferably formed in a form, fill and sealing machine, such as shown in FIGS. 4 and 5, utilizing standard size rolls of film, and described below. For example, in a machine using flexible rolls of film having a width of from 12 to 24 inches (305 mm to 610 mm), a number of wider pouches, for example, up to four viscous food pouches having widths of between 5 and 6 inches (127 to 152.5 mm), and any desired length, such as 12 inches or 305 mm, may be simultaneously formed, filled and sealed when using 24 inch (610mm) film rolls. Such formed pouches preferably contain substantially large amounts of viscous food products in a sanitary manner. For example, such a formed pouch could contain from approximately 24 to 30 fluid ounces (71 to 89 cl) of a viscous food product, such as, ketchup, mayonnaise, mustard, sour cream, various sauces, or the like, to be dispensed from a hand held or similar type dispenser by an employee in a fast food restaurant or other environment, where foods are prepared for sale, or at condiment bars or areas for use by a customer. By using a large size pouch for viscous food products, the products may be more easily shipped, stored and dispensed in a sanitary manner. Furthermore, these pouches will replace large numbers of smaller containers or pouches, such as are currently used, thus enabling substantial savings in energy and materials to be achieved, as well as producing less waste. Finally, by utilizing dispensers which are designed to work with the specifically contoured internal angular seal means 36 and 37 and internal sloping wall 41 of opened outlet spout 24 of the pouch, the food product may be more accurately controlled and dispensed, without the need of an expensive fitment or valving means, such as is contained in or formed to known containers or pouches. This in turn, allows the pouch to be more easily handled, while allowing close maintenance and regulation of the sanitation of the viscous product in the pouch.

After being formed, filled and sealed, the pouch 20 may be shipped and stored until ready for use. In normal use, the pouch is placed in the dispenser 122 and the tip or farther end 25 of outlet spout 24 of pouch 20 is opened or removed by tearing off the tear-off strip 38, formed below the end 28, above both the openings 32, 34 and the angular seal means 36 and 37 of chamber 30. A plurality of perforations 40 are formed in and extend across the entire outlet end, except across the outlet spout 24, substantially parallel to the substantially straight outlet end 28, to allow the tear-off strip 38 to be removed, in a known manner. When the tear-off strip 38 is removed, the end or tip 25 of outlet 24 is also removed to form a nozzle opening to allow the viscous contents of the pouch to be controllably dispensed therethrough from the dispenser. The nozzle opening of spout 24 is preferably controlled by the closure or valve means held in the front plate 132 of the hand held dispenser 122, to regulate the amount of viscous fluid in each shot as the pouch 20 is collapsed in an accordion fashion by the piston operator in the interior cavity 134 of the dispenser 122.

FIGS. 4 and 5 illustrate a typical commercial form, fill and seal pouching machine 42, similar to that disclosed in column 5 of the '330 patent. This machine 42 includes a housing 44, a control unit 46, front heat sealing film 48 on a continuous roll 50, rear heat sealing film 52 on a continuous roll 54, a plurality of tensioning rollers 56, a front side seal bar 58 and a rear side seal bar 60, all of which are similar to and operate in substantially the same manner as the corresponding, but differently numbered, elements in '330.

As more clearly shown in FIG. 5, the front film 48 and rear film 52 are fed between the front and rear seal bars 58 and 60 to form continuous seals or joints between the films, in a known manner. In the machine shown herein, five corresponding front and rear side seal bars are utilized to form the side seals, such as side seals 22 and 23 for four continuous streams of side by side pouches 20. Appropriate cutters, not shown, are utilized in a known manner to sever the continuously formed side seals to form the separate pouches. After formation of bottom seals, as described below, each of the formed pouches is then filled, in a manner known to those skilled in the art, by filling heads 62, contained in the machine 42.

Located below or downstream from the filling heads 62, and replacing the currently available head seal, is a novel head seal means or tooling 64, consisting of front and rear head seal bars or jaws 66 and 68, respectively. A preferred embodiment of this novel head seal tooling 64 is shown in FIGS. 6–12. This head seal means forms the bottom seal 26 and the top cross seals and related components, consisting of the angular seal means 36 and 37, as well as the centrally disposed outlet spout 24, the alignment openings 32 and 34, the perforations 40 in pouches 20. This head seal also includes means to cut off the formed pouches from the streams of front and rear film, and may include means to form a further outlet end cross seal, adjacent the outlet end 28.

Figure 6:
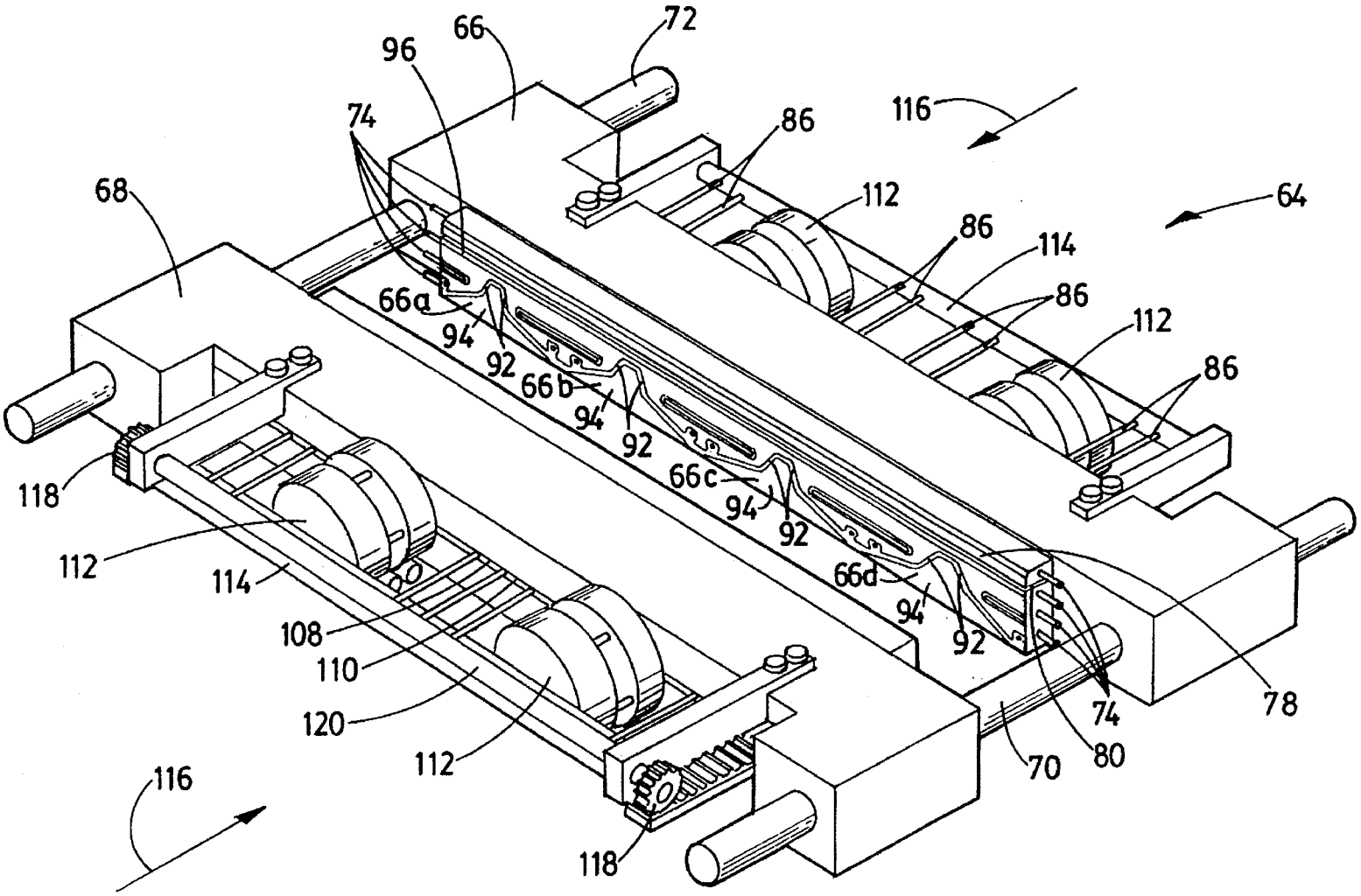
FIG. 6. is a perspective view of the head seal in accordance with the present invention.

Turning now to FIG. 6, there shown are the separate jaws 66 and 68 of the tooling 64 slidably held on a pair of bars 70 and 72, in a known manner, by openings formed at either end of the jaws, to enable the surfaces of the jaws to be brought together, by means (not shown), known to those skilled in the art, to form the cross seals, etc. Each of the movable jaws or heads 66 and 68 is heated by a plurality of elongated pin type heaters 74, extending from both end thereof, and preferably four in number, inserted and held in openings 76 formed in the jaws, as shown more clearly in FIGS. 11 and 12. These heating elements are wired in a manner know to those skilled in the art, and operated by the control unit 46, in a known manner, to heat the jaws 66 and 68 to form the seals in the films, by the combination of this heat, and the pressure of the jaws 66 and 68 when they are brought together.

Figure 8:
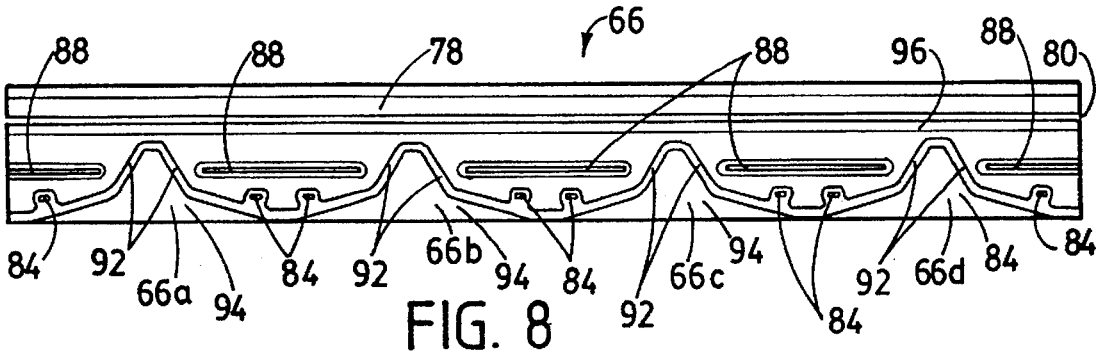
FIG. 8. is a front elevational view of the other jaw of the head seal of FIG. 6.
Figure 9:
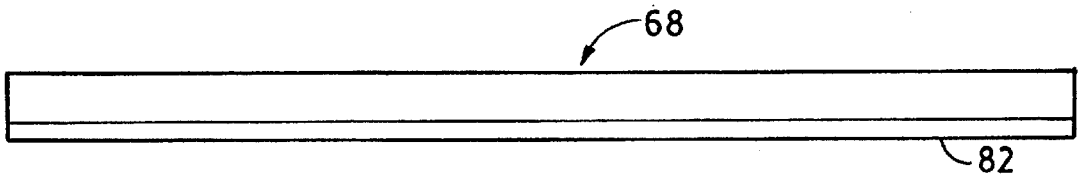
FIG. 9. is a partial top elevational view of the head seal jaw of FIG. 7.
Figure 10:
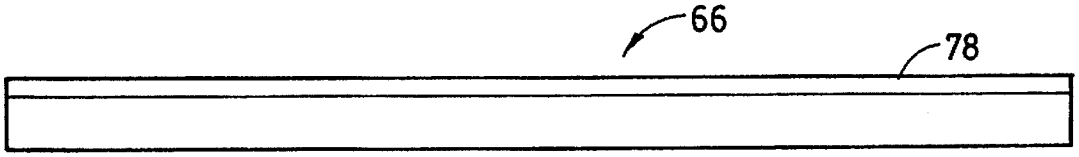
FIG. 10 is a partial top elevational view of the head seal jaw of FIG. 8.
Figure 11:
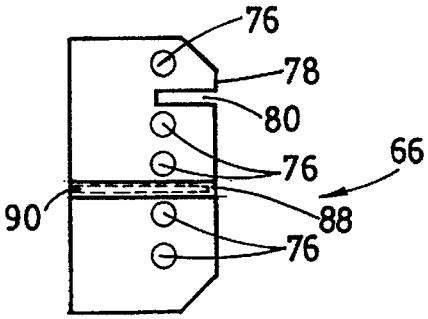
FIG. 11. is a partial end view of the head seal jaw of FIG. 8.
Figure 12:
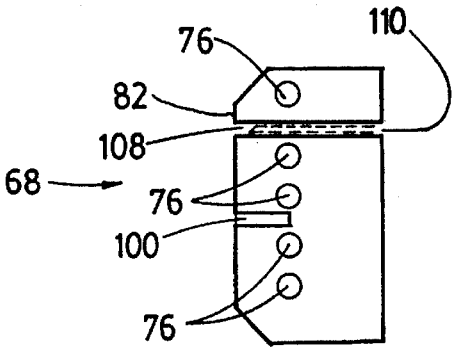
FIG. 12. is a partial end view of the head seal jaw of FIG. 7.

As illustrated in FIGS. 6 and 8, the front surface of the jaw 66, is shown, for example only, and not by way of limitation, as including four pouch forming areas, marked as **66*a*, 66*b*, 66*c* and 66*d*, to form four separate pouches at a time, when they are brought into contact with four corresponding areas 68*a*, 68*b*, 68*c* and 68*d* on the front surface of jaw 68. Above these areas 66*a–d* are a cross seal portion 78, and a cut-off receiving area or depression 80, each of which extend along the entire face thereof. The cross seal portion 78 coacts with a corresponding cross seal portion 82 extending across the entire front face of jaw 68 to form the bottom seal 26 of a top, partially formed pouch (side seals only), when the jaws 66 and 68** are brought together, before filling and completion of the top pouch, as described more fully below.

Each of the areas **66*a–d* on the front surface of jaw 66 includes the following elements to form the top cross seal having outlet spout 24 and angular seal means 36 and 37, openings 32 and 34, the perforations 40, and, if desired, a further top cross seal adjacent end 28, in a completed and filled pouch 20: a pair of openings 84 through which a pair of punches 86 (see FIG. 6) are reciprocated to form the openings 32 and 34 in the pouch; slotted openings 88 through which a multi-bladed perforator 90 slides to form the perforations 40; a raised, substantially funnel or hat-shaped, combination outlet and angular seal means forming surface 92, surrounding an insulated area 94; and if a further top cross seal is desired adjacent end 28, a further raised seal forming area 96, which preferably extends entirely across the face or front surface of jaw 66**.

Figure 7:
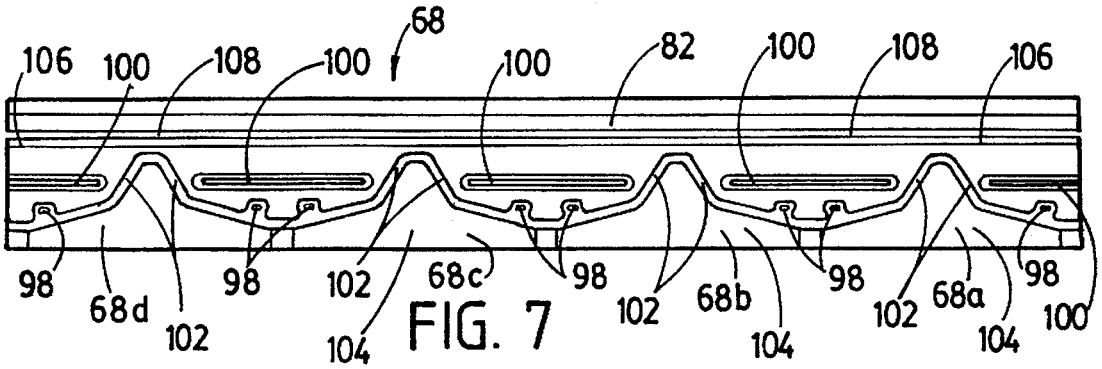
FIG. 7. front elevational view of one of the jaws of the head seal FIG. 6.

As shown in FIG. 7, each of the corresponding areas **68*a–d* on the front surface of jaw 68 includes the following elements which cooperate with the respective or corresponding elements on the front surface of jaw 66 to enable the tooling 64 to form the outlet spout 24, angular seal means 36 and 37, openings 32 and 34, the perforations 40, to cut-off a completed filled and sealed pouch 20, and if used, to form the further top cross seal: a pair of recessed holes 98 to receive the ends of the plurality of punches 86 when they are reciprocated to form the openings 32 and 34, after they pass through the sheets of film; slotted recesses 100 to receive the ends of the perforator blades 90, when the blades form the perforations 40; a raised complementary surface 102, surrounding an insulated area 104, against which the raised, funnel or hat-shaped, combination outlet spout forming and angular seal means forming surface 92 of the front surface of jaw 66 presses the front and rear films film, and, if the further top cross seal is to be added and the further raised seal forming area 96 is located on each of the areas 66a-d on front jaw 66, a further flat surface 106 against which the further raised seal forming area 96 presses the front and rear films. Furthermore, an elongated opening 108 is formed through the jaw 68, across from and cooperating with the recess 80 formed in the jaw 66. A cut-off means 110, such as a cut-off blade (see FIG. 12), reciprocates in opening 108 to cut-off formed pouches 20 when the cut-off blade passes through the front and rear films into recess 80**.

During operation of the head seal, the jaws 66 and 68 are first brought together to form the various seals by heat and pressure. Then, the punches 86, perforation blades 90 and cut-off blade 110, are operated, preferably as follows: operating means 112, such as a plurality of pistons, as shown in FIGS. 4 and 6 are actuated, in any known manner, such as by means of a compressed fluid fed to the interior thereof to move the internal pistons. The operating means 112 is preferably directly connected to a bar or strongback 114, to move the strongback, in the direction of the arrow 116, toward the front or forward surface, of each of the jaws 66 and 68. This movement of the bars 114 is controlled by rack and pinion means 118, connected together, at both ends of each jaw 66 and 68, by a rod 120, and simultaneously moves the punches 86, perforation blades 90 and cut-off blade 110, attached to the respective bars, to perform the required actions, as described above.

It, therefore, can be seen that the uniquely sized and shaped collapsible dispenser pouch, for use in a hand held dispenser of the type disclosed herein, and tooling for making the same of the present invention, provides a novel means for allowing sanitary food and other viscous products to be quickly and easily placed in pouches and sealed therein in such a manner that the pouches are easily handled, stored and used to dispense the product contained therein, in controlled, measured quantities. The product in the pouches are protected from being contaminated in any manner whatsoever, during the shipping, handling, storage and dispensing thereof. Furthermore, by using relatively large size pouches, of a size still usable in a hand held or similar dispenser, substantial savings in energy, materials and time are produced, with less waste generated.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A dispenser system for dispensing viscous material from a collapsible pouch fabricated of flexible film material whereby said collapsible pouch is collapsible in an accordion fashion, comprising:

a dispenser including a cylinder-type housing means for holding said collapsible pouch, said cylinder-type housing means having an opening at one end and being substantially elliptical in cross-section;

a substantially elliptically shaped piston-type extruding member movable in said cylinder-type housing means; and means for moving said substantially elliptically shaped piston-type extruding member relative to said cylinder-type housing means for advancing said substantially elliptically shaped piston-type extruding member toward said opening to extrude the viscous material from said collapsible pouch; and said collapsible pouch being formed from a pair of films sealed together to define a hollow internal chamber for holding the viscous material;

said collapsible pouch including a cross seal having an outlet spout formed therein that is registrable with said opening in said cylinder-type housing means; and said collapsible pouch being adapted to assume the substantially elliptical shape of said cylinder-type housing means when held therewithin and engageable by said substantially elliptically shaped piston-type extruding member.

2. The dispenser system of claim 1 wherein said outlet spout is disposed generally centrally of said cross seal and includes sloped internal wall portions diverging away from said hollow internal chamber.

3. The dispenser system of claim 2 wherein said cross seal includes sloped internal wall portions diverging from said hollow internal chamber toward said outlet spout.

4. The dispenser system of claim 3 wherein said sloped internal walls of said cross seal are joined by radiused wall portions directly to said sloped internal wall portions of said outlet spout.

5. A dispenser system including a collapsible, sanitary dispenser pouch formed from thin films of sheet material for holding a substantially large amount of viscous food product for dispensing from a dispenser, comprising in combination:

said dispenser pouch being formed from a pair of substantially rectangular heat sealable films having two ends and two sides and being heat sealed together along said two sides by substantially straight side seals;

a first of said two ends being heat sealed together so as to form a bottom, substantially straight cross seal;

a portion of the other of said two ends being heat sealed together so as to form a top cross seal having a specifically formed sealed outlet spout portion therein;

a hollow internal chamber formed between said substantially straight side seals, said bottom substantially straight cross seal and said top cross seal to hold said substantially large amount of viscous food product therein;

said specifically formed sealed outlet spout portion including sloped internal walls and an outlet tip and being centrally disposed between said substantially straight side seals; said sloped internal walls of said specifically formed sealed outlet spout portion forming a single interior surface which slopes toward said outlet tip to form a funnel-shaped interior area to control the flow of viscous product held in the said hollow internal chamber through said specifically formed sealed outlet spout portion;

said top cross seal including sealed portions formed between said pair of substantially rectangular heat sealable films adjacent to and angularly disposed between said sloped internal wall portions of said specifically formed sealed outlet spout portion and said substantially straight side seals to form angled internal walls in said hollow internal chamber; and a tear-off strip formed in said other of said two ends, away from said hollow internal chamber, by a plurality of perforations formed therein and extending across said other of said two ends, up to but not across said outlet tip of said specifically formed sealed outlet spout portion, whereby, when said tear-off strip is removed by a user, said outlet tip will be removed to form an outlet opening through which controlled dispensing by an hand-held dispenser of said viscous food product from said hollow internal chamber via said angled internal walls will occur, so as to enable said viscous food product held in said hollow internal chamber to be substantially completely dispensed through said outlet opening formed by the removed outlet tip.

6. The dispenser system of claim 5 wherein said angled walls of said dispenser pouch are at angles of approximately 75 degrees with respect to said substantially straight side seals.

7. The dispenser system of claim 5 wherein said sloped internal wall portions forming said funnel-shaped interior area of said dispenser pouch are sloped at an angle of approximately 30 degrees with respect to a centerline of said dispenser pouch, which centerline is disposed parallel to said substantially straight side seals and passes generally centrally through said dispenser pouch and the outlet spout portion.

8. The dispenser system of claim 3, further including substantially smooth, rounded edges formed between said angled internal walls and said funnel-shaped interior area in said hollow internal chamber of said dispenser pouch.

9. The dispenser system of claim 8 wherein said hollow internal chamber of said dispenser pouch carries between 24 and 30 liquid ounces of said viscous product.

10. The dispenser system of claim 5 wherein said dispenser for dispensing said substantially large amount of viscous food product from said dispenser pouch includes an elliptically shaped internal cavity for holding said dispenser pouch therein, and said dispenser pouch assumes an elliptical shape when held and pressurized in said internal cavity.

11. The dispenser system of claim 10 wherein said elliptically shaped internal cavity of said dispenser has two ends so that said dispenser pouch assumes the shape of said elliptically shaped internal cavity when secured and pressurized therein, with said outlet spout secured in an opening in one of said two ends.

12. The dispenser system of claim 11 wherein said dispenser is hand held and includes a piston-type operator movably mounted in said internal cavity to pressurize and collapse said dispenser pouch in said internal cavity in response to operation of said piston-type operator.

13. The dispenser system of claim 12 wherein said piston-type operator pressurizes said dispenser pouch in said internal cavity to cause said dispenser pouch to collapse in an accordion-like manner, while said outlet spout is secured in said one of said two ends of said internal cavity.

* * * * *